United States Patent [19]

Sardella

[11] Patent Number: 4,632,378

[45] Date of Patent: Dec. 30, 1986

[54] METHOD AND APPARATUS FOR STACKING SERIALLY ADVANCING PARALLEL STREAMS OF BLANKS

[75] Inventor: Louis M. Sardella, Cockeysville, Md.

[73] Assignee: The Ward Machinery Company, Cockeysville, Md.

[21] Appl. No.: 699,208

[22] Filed: Feb. 7, 1985

[51] Int. Cl.[4] ..... B65H 29/36

[52] U.S. Cl. ..... 271/202; 271/271; 414/73; 198/689.1

[58] Field of Search ..... 271/202, 203, 196, 197, 271/299, 270, 271, 272; 414/73, 77; 198/461, 8 A, 689.1; 83/102, 110, 152

[56] References Cited

U.S. PATENT DOCUMENTS

| | | | |
|---|---|---|---|
| 2,895,552 | 7/1959 | Pomper et al. | 271/197 X |
| 3,153,533 | 10/1964 | Novick | 271/271 |
| 3,860,232 | 1/1975 | Martin | 271/299 X |

*Primary Examiner*—Douglas C. Butler
*Assistant Examiner*—Matthew C. Graham
*Attorney, Agent, or Firm*—Boyce C. Dent

[57] ABSTRACT

A method and an apparatus for stacking serially advancing parallel streams of blanks, such as corrugated paperboard blanks, by serially advancing such parallel streams in which there are spaces between pairs of such blanks in each of the streams but no spaces between the blanks of the pairs, creating spaces between the blanks of each pair during advance, stopping the advance of the blanks one after the other, and guiding succeeding spaced blanks one on top of the other to form a stack of blanks from each stream.

11 Claims, 12 Drawing Figures

METHOD AND APPARATUS FOR STACKING SERIALLY ADVANCING PARALLEL STREAMS OF BLANKS

CROSS REFERENCES TO RELATED APPLICATIONS

This invention relates to copending application Ser. No. 06/472,855 for Blank Stacking Apparatus filed Mar. 7, 1983 by Henry D. Ward, Jr. et al and assigned to the assignee of the present invention.

SUMMARY OF THE INVENTION

A method of stacking paperboard blanks which includes serially advancing a stream of blanks in which there are spaces between pairs of such blanks and no spaces between the blanks in the pairs; creating spaces between the blanks of the pairs; stopping the advance of the blanks after the spaces are formed; and guiding the blanks downward one on top of the other to form a stack.

The method also embraces the stacking of parallel streams of blanks. Accordingly the method also includes serially advancing a second stream of blanks laterally adjacent to the first stream; creating a lateral space between the two streams during their advance; stopping the advance of the blanks in the second stream; and guiding the blanks downward to form a second stack spaced from but adjacent to the first stack.

Apparatus for stacking paperboard blanks, particularly irregular-shaped die cut blanks, including timed endless conveyor belts through which suction pressure is applied to hold the leading edges of the blanks against the lower runs of the belts to advance them serially against individually adjustable stops, positioned to engage irregular-shaped leading edges on the blanks, whereupon the leading edges are released from the suction pressure permitting the blanks to settle upon an elevator which lowers incrementally or continuously to form a stack of blanks thereon. When the stack is completed, interrupter tines move down from over the timed conveyor belts to beneath the timed conveyors belts to store subsequently released blanks while the stack is discharged by driven rollers on the elevator after which it rises to its starting position. The tines are withdrawn and the blanks stored thereon settle onto the elevator to form a new stack with blanks subsequently released by the timed conveyor belts. A counter is used to energize operation of the tines to form stacks of a predetermined number of blanks on the elevator. An inclined conveyor is used to serially advance the blanks into contact with the timed conveyor belts. The inclined conveyor includes conveyor belts through which suction pressure is applied to hold the blanks firmly on the upper runs of the belts during advancement to the timed conveyor belts.

The apparatus is arranged to stack either one or two blanks moving serially in the machine direction and from one to three blanks moving side by side in the machine direction, all of such blanks being made from a single rectangular blank entering a die cutter machine ahead of the stacking apparatus which die cuts it into a single die cut blank or into as many as six die cut blanks.

The inclined conveyor is arranged such that selected combinations of its conveyor belts may be skewed with respect to the path of travel to provide lateral spaces between the side by side blanks to prevent interference during stacking.

The timed conveyor belts are made in pairs running in tandem with two or three pairs provided for each stream of side by side blanks. These belts include arrays of vacuum ports through which vacuum is applied to hold the leading edges of the blanks against the lower runs of the belts until the blanks reach a number of lead-edge stops at which time the vacuum ports run out of contact with the blanks which then descend onto the elevator.

The position of the array of vacuum ports in one of the belts of each pair of timed conveyor belts may be varied with respect to the position of the array in the adjacent belt. The first belt cycle is adjusted so that its array engages the leading edge of the first blank of a pair of serially advancing blanks from the same die cut. The first belt is arranged to run faster than and then slower than the constant speed of the adjacent belt of the pair. Thus, the first blank moves ahead of the second blank, hits the leading edge stop, and then falls toward the elevator before the second blank reaches the stop. This permits so-called two-up blanks to be stacked one on top of the other on the elevator. The first belt speeds up to provide a space between the blanks but then runs slower, by a corresponding amount, than the second belt such that the cyclic period of each belt is identical. The length of the timed conveyor belts is preferably twice the repeat length of the die cutter and includes two arrays of vacuum ports spaced equidistant around the length of the belts. Thus, each belt is two cycles long and one cycle is returning to the starting position while the other cycle is working. The conveyor belts are timed to bring an array of holes into contact with the leading edges of the first blank supplied from the inclined conveyor and the array on the adjacent belt into contact with the lead edge of the second blank. In this manner, each blank is advanced beneath the lower run of the conveyor belts until the belts turn around the head pulley of the conveyor which breaks the vacuum connection with the blank; the stops are positioned to stop the advance of the blanks when the vacuum connection is broken so that the blanks settle upon the elevator. When two-up blanks are being stacked, the two arrays of vacuum ports in the second belt of the pair are phase shifted with respect to those in the first belt. Thus, the first and second arrays in the first belt engage the first and third blanks of four serially advancing blanks and the first and second arrays in the second belt engage the second and fourth blanks.

If desired, the interrupter tines may be omitted and, instead, the supply of blanks to the stacker interrupted during such time that the stack of blanks on the elevator is being discharged. This may be accomplished by electrically energizing a conventional stop feed mechanism, on the box machine supplying the blanks, in response to the stack of blanks on the elevator reaching a predetermined height or in response to the number of blanks on the elevator reaching a predetermined number.

DESCRIPTION OF THE PREFERRED EMBODIMENT

The blank stacking apparatus shown in the aforementioned patent application Ser. No. 06/472,855 has been improved to provide increased production by enabling the apparatus to stack from one to three-out blanks and either one or two-up blanks. The prior apparatus was capable of stacking one or two-out blanks but only one-up blank.

Figure 1:
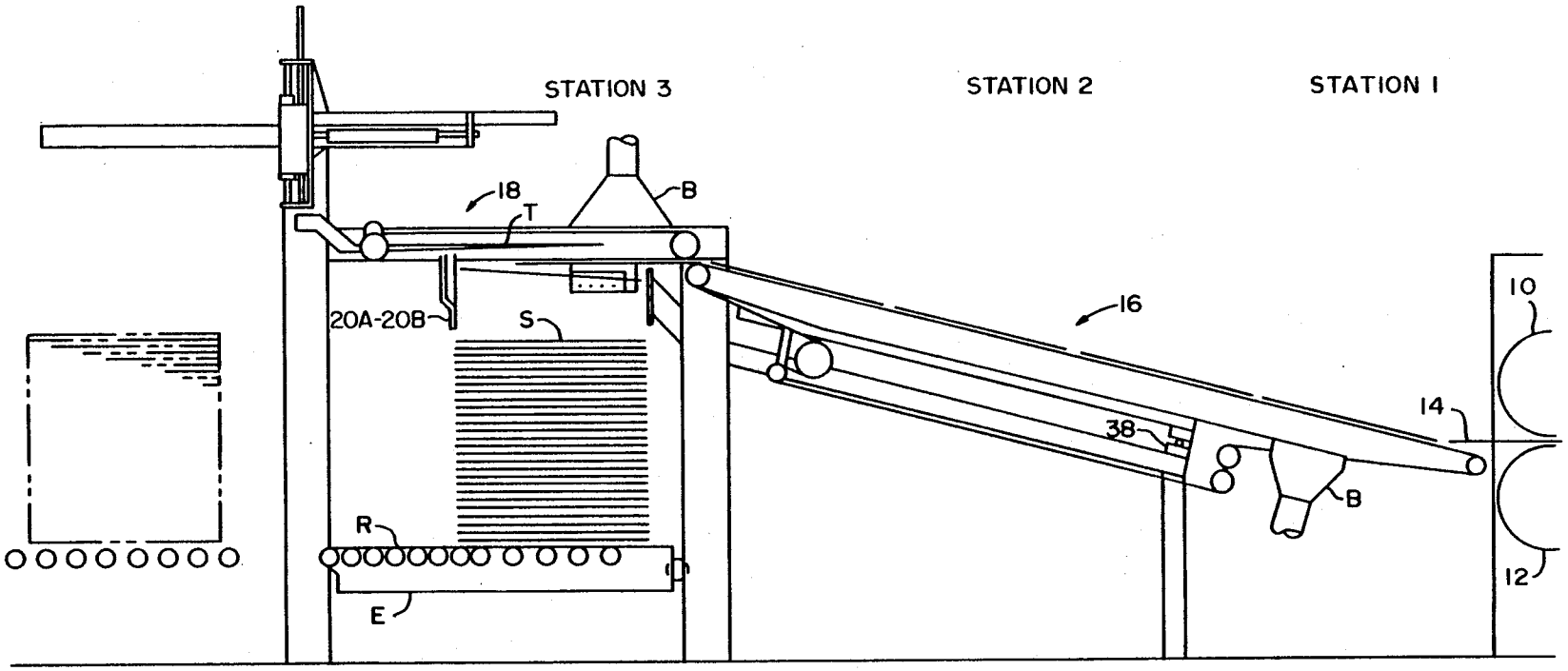
FIG. 1 is a schematic illustration in side elevation representing a rotary die cutter, inclined conveyor, and a stacking apparatus.
Figure 2:
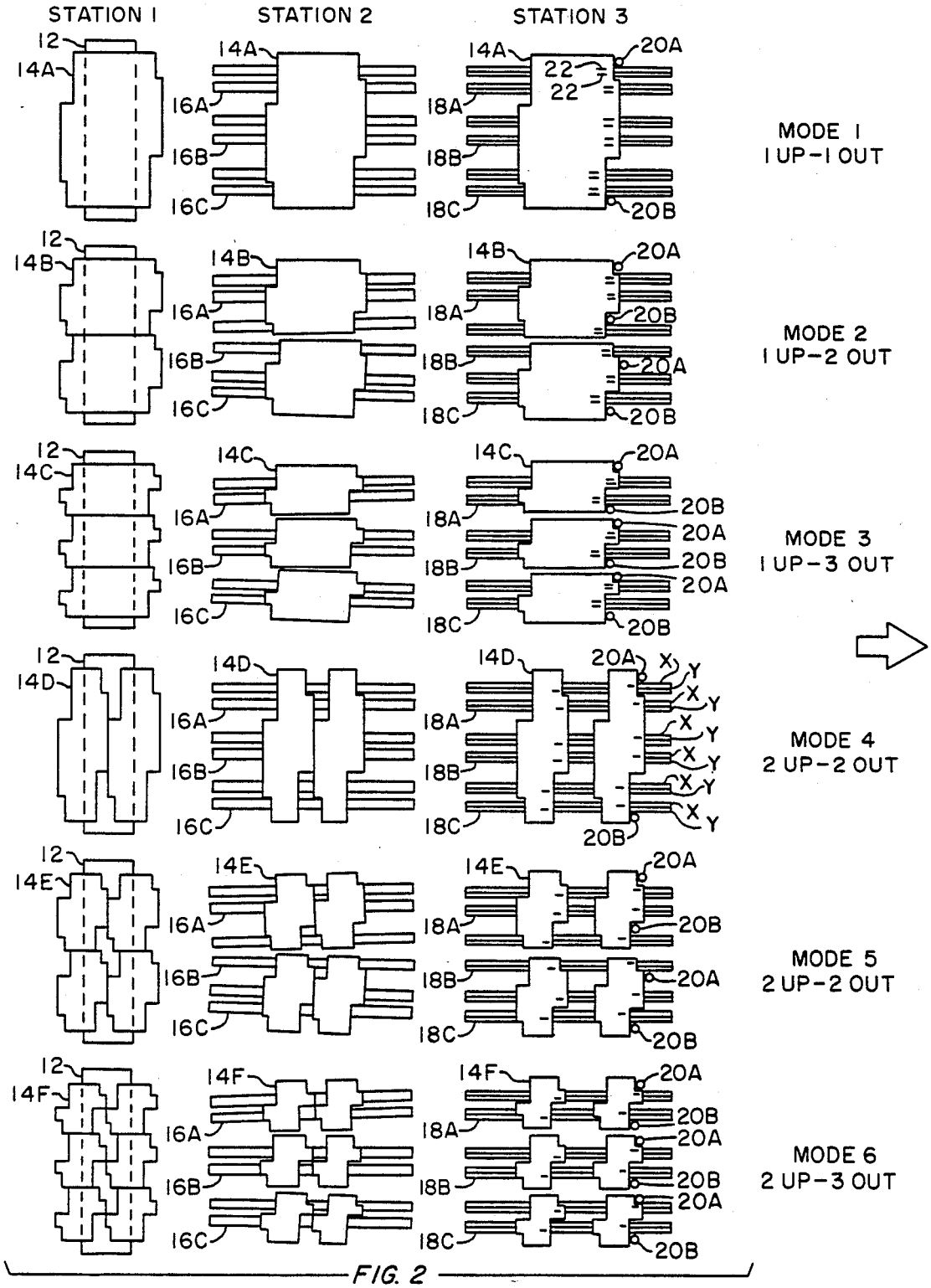
FIG. 2 is a schematic illustration in plan view representing the operating modes of the three work stations illustrated in FIG. 1.

With reference to FIG. 2, the production of one-up one-out blanks comprises the production of a single blank in the machine direction (unnumbered arrow in FIG. 2) and in the cross-machine direction for each machine cycle (such as one revolution of a rotary die cutter schematically illustrated as station 1 in FIG. 1)—denoted as Mode 1 in FIG. 2.

One-up two-out blanks are produced as one blank in the machine direction and two blanks in the cross-machine direction—denoted as Mode 2 in FIG. 2.

One-up three-out blanks are produced as one blank in the machine direction and three blanks in the cross-machine direction—denoted as Mode 3 in FIG. 2.

Two-up one-out blanks are produced as two blanks in the machine direction and one blank in the cross-machine direction—denoted as Mode 4 in FIG. 2.

Two-up two-out blanks are produced as two blanks in the machine direction and two blanks in the cross-machine direction—denoted as Mode 5 in FIG. 2.

Two-up three-out blanks are produced as two blanks in the machine direction and three blanks in the cross-machine direction—denoted as Mode 6 in FIG. 2.

The cylinders 10 and 12 at station 1 of FIG. 1 represent the upper die cylinder and lower anvil cylinder of a conventional rotary die cutter. An advancing blank 14 can be die cut into an irregular shape such as shown by 14A at the corresponding station 1 in FIG. 2 as well understood by those skilled in the art. Blank 14A may also be die cut in the machine direction into two blanks 14B or three blanks 14C which will continue to advance side by side out of the rolls 10 and 12. Blank 14A may also be die cut in the cross-machine direction into two blanks as denoted by numberals 14D, 14E, and 14F which will continue to advance serially out of the rolls 10 and 12. Thus, the rolls 10 and 12 can produce from one to six blanks during each revolution or machine cycle. It should be understood that the maximum width blank in the machine direction corresponds approximately to the circumference of the rolls 10 and 12. Thus, if the width of the final blank to be produced is equal to or less than one-half such circumference, then blank 14A may be divided into two blanks 14D. This, in effect, doubles the production of the machine in relation to the number of revolutions of the cylinders 10 and 12. Until now, doubling the production of blanks in this manner was impractical because the blanks could not be stacked automatically.

To be able to stack multiple blanks in a practical manner, it is necessary to separate them in both the cross-machine direction and in the machine direction. In this invention, the blanks are separated in the cross-machine direction by an inclined conveyor assembly 16 at station 2 in FIG. 1. Conveyor assembly 16 includes three pairs of endless conveyor belts 16A, 16B, and 16C which can be skewed to cause separation of the blanks 14 in the cross-machine direction as shown at station 2 in FIG. 2.

More specifically, referring to Mode 1 of station 2 in FIG. 2, the conveyor pairs 16A–16C are not skewed because cross-machine separation is not required.

At Mode 2 of station 2, pairs 16A and 16C are skewed away from the center along with an adjacent one of the conveyor pair 16B to separate two blanks 14B.

At Mode 3 of station 2, the center conveyor pair 16B remains straight while the outer pairs 16A and 16C are skewed away from center. This causes the center blank 14C to advance straight ahead and the outer blanks 14A and 14C to advance at an angle away from the center blank to achieve cross-machine separation.

At Mode 4 of station 2, all the pairs 16A–16C remain straight because cross-machine separation is not required.

At Mode 5 of station 2, the conveyors 16A–16C are skewed in the same manner as in Mode 2 to achieve separation of both serially advancing blanks 14E in each path.

At Mode 6 of station 2, the conveyors 16A–16C are skewed in the same manner as in Mode 3 to achieve separation of both serially advancing blanks 14F in each of three paths.

When two-up blanks (two blanks advancing in serial fashion - station 2, Mode 4 of FIG. 2) are being processed, it is necessary to separate them in the machine direction to permit the first blank 14D to be stacked before the second blank is stacked. In effect, this is the same as stacking serially advancing blanks 14A being produced one for each machine cycle as shown in Mode 1 of FIG. 2 which have naturally occurring spaces between them.

It should be understood that single blanks produced by the die cutter cylinders 10 and 12 have a space between them in the machine direction (usually about one to two inches) but when two blanks are produced from one blank during one revolution of the cylinders, there is no space between that pair of blanks. A space is needed between them to permit the first blank of the pair to be stopped in the timed conveyor and settle on the stack before the second blank is stopped.

It should also be understood that some machine direction separation of the blanks of each pair can be provided by speeding up the conveyor 16 with respect to the speed of the die cutter cylinders 10 and 12. However, the amount of spacing is a function of the width (in the machine direction) of the blank being produced and the amount of advance of the first blank of the pair on conveyor 16 while the second blank of the pair is still being gripped by the die cutter cylinders and is slipping on conveyor 16. Thus, it is not practical to achieve the spacing needed by simply speeding up the conveyor 16. It is far better to provide a substantially even spacing (preferably about nine inches) between the blanks of each pair of blanks. Hereinafter in the specification and claims, reference to no spacing between the blanks of the pair means no spacing or very little spacing produced by speeding up the conveyor 16 relative to the die cutter cylinders 10 and 12. The reference to spacing means the spacing between the pairs that occurs as a result of the width of the blanks being processed plus whatever increase in spacing is produced by the conveyor 16.

Machine direction separation is achieved by the top conveyor assembly 18 represented schematically in FIG. 1. Conveyor assembly 18 includes three pairs of endless conveyors 18A, 18B, and 18C as represented schematically in FIG. 2. Each belt of each pair comprises two belts X and Y running in tandem for a total of twelve individual belts as indicated at Station 3, Mode 4. The X and Y belts are arranged such that the Y belts move at a constant preselected speed but the X belts first move faster than the Y belts and then slower by a corresponding amount so that the total distance traveled per cycle by the X and Y belts remains constant.

The arrangement is such that the first blank 14D (station 3, Mode 4, FIG. 2) is engaged by the X belts which speed up the blank to create a space between it and the following blank which is engaged by the Y belts and advanced at constant speed. Thus, the first blank 14D is accelerated and advances against the stops 20A and 20B at which point it is released by the conveyors 18A–18C and settles upon the stack S as shown in FIG. 1. Meanwhile, the following blank 14D is engaged by the Y belts and advances at constant speed against the stops 20A and 20B where it is released and settles upon the stack S. Thus, these two blanks, produced by one machine cycle, are stacked one upon the other during one machine cycle, that is, one revolution of cylinders 10 and 12.

When stacking two-up two-out blanks such as represented by Mode 5 at station 3 in FIG. 2, the first top blank 14E (as viewed in FIG. 2) is engaged by three X belts and the second top blank 14E is engaged by three Y belts which advance the blanks sequentially against stops 20A and 20B for stacking the blanks as previously described for the blanks 14D at station 3, Mode 4. In similar fashion, the first bottom blank 14E is similarly engaged by three X belts and accelerated against the stops 20A and 20B. Then the second bottom blank 14E is engaged by three Y belts and advanced at constant speed against the corresponding stops 20A and 20B.

The blanks 14F shown at station 3, Mode 6 are advanced in similar fashion to that just described except that the first top blank is engaged by two X belts and the second top blank is engaged by two Y belts. Similarly, the first center blank and the first bottom blank are each engaged by two X belts and the second center and second bottom blanks are each engaged by two Y belts.

Machine direction separation of the blanks 14 is required only for two-up blanks. Accordingly, when one-up blanks (such as those illustrated at station 3 in FIG. 2) are being processed, the X and Y belts are caused to be rotated at the same speed since machine direction separation is not necessary.

It should also be understood that each of the twelve individual belts 18 has two arrays of vacuum ports for engaging the advancing blanks 14. Consider for the moment though, that each belt 18 has only one array of vacuum ports as illustrated by the small dash denoted by numeral 22 for the top pair of belts 18A at station 3, Mode 1 of FIG. 2. The number 22 has been omitted from the remaining belts for clarity.

In Modes 1–3, the vacuum ports 22 of all the belts 18 are in phase with each other and aligned to engage the leading edges of the blanks in all three modes. This is accomplished by adjusting the Y belts as a set relative to the X belts. Thus, all X belts move together and all Y belts move together. However, when two-up blanks are being processed, such as in Modes 4–6, the ports 22 in the X belts are aligned to engage the leading edges of the first of the blanks advancing for each machine cycle. The Y belts are retarded with respect to the X belts such that the ports 22 are aligned with the leading edges of the second of the blanks advancing for each machine cycle. In this manner, the X and Y belts are caused to engage the first and second blanks respectively. The Y belts may be rotated with respect to the X belts by a conventional air clutch (not shown) between the drive shaft 82 and the point at which it is connected to the drive system for the machine (not shown).

Each of the belts 18 has two arrays of vacuum ports 22 equally spaced from one another. The total length of the belts is twice the repeat length of the die cutter cylinders 10 and 12 which is only slightly longer than the maximum width blank that can be processed. Thus, the two arrays permit the X belts to engage two first blanks during two machine cycles, as more specifically described in the aforementioned patent application Ser. No. 06/472,855, for each cycle the belts. It also permits the Y belts to engage two second blanks during the same two machine cycles for each cycle of the belts.

As described in connection with FIG. 2, a rectangular blank 14 may be die cut into a single irregular-shaped blank 14A by the die cutter rolls 10 and 12 shown at station 1. These same rolls are capable of die cutting the blank into a number of blanks 14A–14C across the width of the machine to produce from one to three-out blanks. The die cutter rolls are also capable of cutting the blank 14 into two irregular-shaped blanks along the length of the machine as illustrated by blanks 14D–14F at station 1 to produce from one to two-up blanks. The construction and operation of the die cutter rolls 10 and 12 are well known by those skilled in the art and no further description is believed necessary. Such die cutting rolls per se form no part of this invention.

Cross-machine direction separation of the blanks 14B, 14C, 14E, and 14F is provided by the inclined conveyor assembly 16 schematically illustrated in FIG. 1. The construction of this conveyor is substantially the same as described for the inclined conveyor assembly 12 of copending application Ser. No. 06/472,855 referred to above. The main difference is in the construction and operation of the portions that provide separation of the blanks 14 in the cross-machine direction as will now be described.

Figure 3:
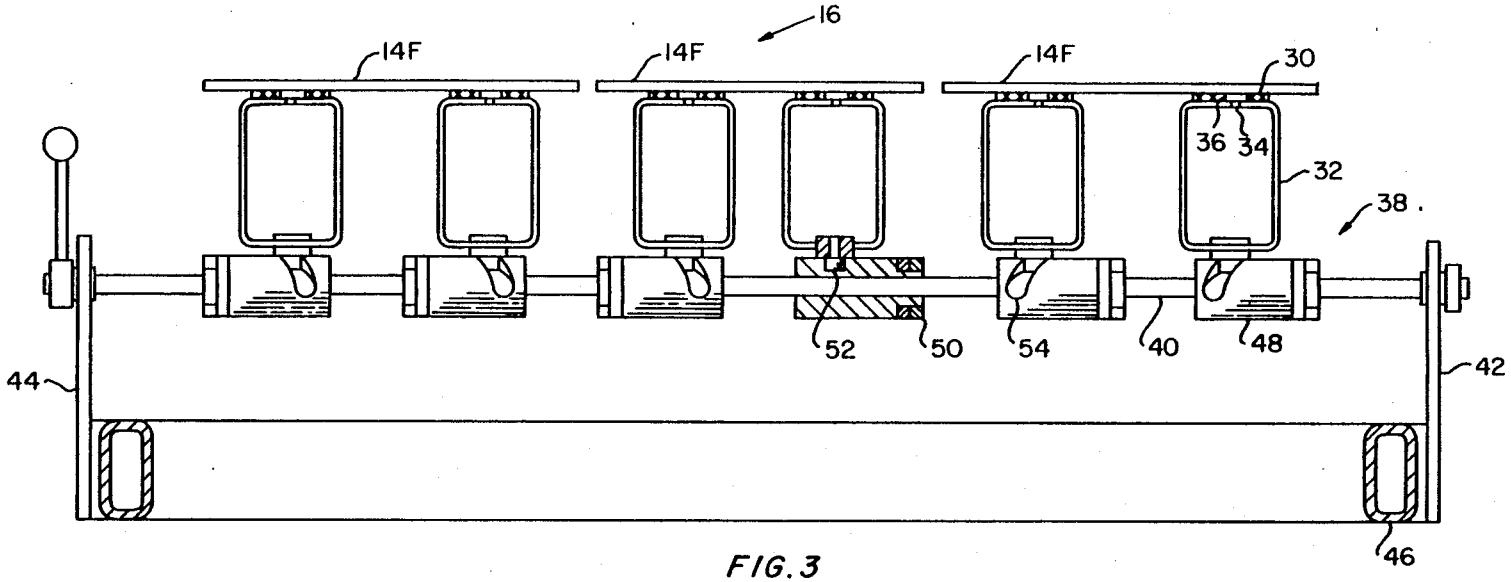
FIG. 3 is an illustration showing the adjusting mechanism for the individual conveyors of the inclined conveyor of FIG. 1.
Figure 4:
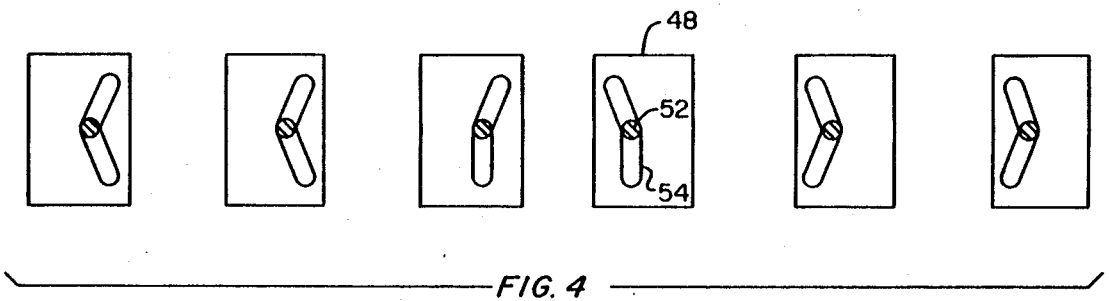
FIG. 4 is a schematic illustration showing the adjustment positions of the adjusting mechanism of FIG. 3.

Referring now to FIGS. 3 and 4, the conveyor 16 includes six endless conveyor belts 30, the top runs of which are supported by members 32. Negative atmospheric pressure or vacuum is supplied to the interior of members 32. The vacuum is applied to the bottom surfaces of blanks 14F, for example, through holes 34 in members 32 and slots 36 in the belts 30 to cause the blanks 14F to adhere to the belts 30 to keep the blanks under positive control. This arrangement is substantially the same as described in the aforementioned co-pending application.

The adjusting mechanism for skewing the individual conveyor assemblies 16 is generally denoted by numeral 38 in FIGS. 1 and 3. Referring to FIG. 3, adjusting mechanism 38 includes a square cross shaft 40 supported by side plates 42 and 44 which are secured to a main frame 46. A barrel cam 48 is placed on cross shaft 40 at the end of each channel support 41 that supports members 32. Thus, rotation of cross shaft 40 will turn the cams 48 in unison. Plates 43 surround a shoulder 47 on each barrel cam 48 and are secured to each channel support 41 to restrain the cams 48 against lateral movement except when the channel supports are moved laterally to accommodate the length of the blanks 14 being processed. Collars 50 retain the plates 43 on the shoulders 47. A guide pin 52 is secured to each support 32 and rides in a groove 54 in each cam 48.

The grooves 54 in cams 48 are shaped as shown in FIG. 4 which is substantially a flat top view of the cams of FIG. 3. As shown in FIG. 4, the pins 52 are in the middle of the circumferential length of grooves 54; in this position, the supports 32 (and hence belts 30) are in alignment in the machine direction and will advance the blanks in a straight line as shown in FIG. 2, station 2, Modes 1 and 4 for advancing one-out blanks.

However, it can be seen that when the cross shaft 40 is rotated in a first direction, the pins 52 will move to the top ends of the grooves (as viewed in FIG. 4). In doing so, they will shift the three supports 32 on the left toward the center and shift the three supports 32 on the right towards the center. This will result in a skewed alignment of the conveyors 16 as shown in FIG. 2, station 2, Modes 2 and 5 for advancing two-out blanks since each support member 32 is pivot mounted (pivot P, FIG. 1) at its opposite end to the channel support 41.

Rotation of shaft 40 in the opposite direction will move pins 52 to the bottom end of grooves 54 (as viewed in FIG. 4). In this position, the pins will have shifted the two left side supports 32 toward the center and the two right side supports toward the center but will have left the two center supports 32 in a straight line in the machine direction in the center. Thus, only the two outboard supports on each side will be skewed with respect to the center supports. This will result in a skewed alignment of the conveyors 16 as shown in FIG. 2, station 2, Modes 3 and 6 for advancing three-out blanks.

The foregoing provides the means for providing cross-machine separation of advancing two or three-out blanks or no separation when one-out blanks are being processed.

Figure 5:
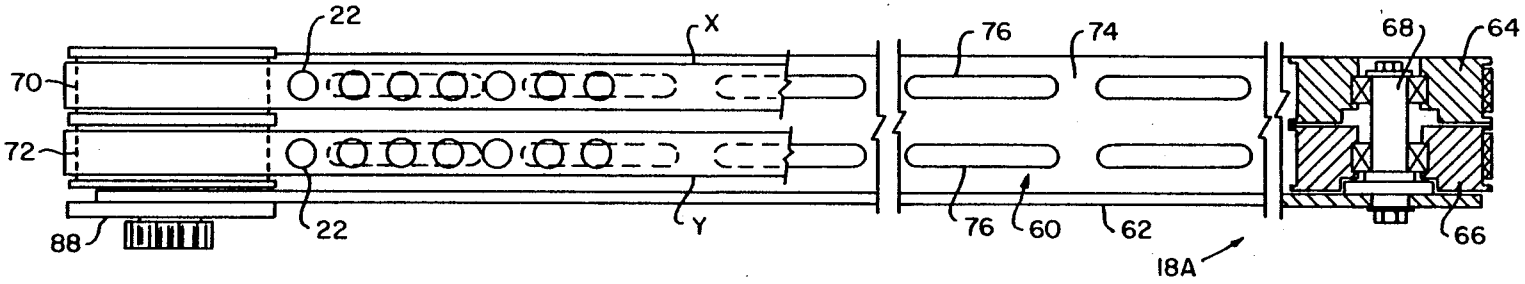
FIG. 5 is a bottom view of one timed conveyor pair of the timed conveyors of FIG. 1.

Machine direction separation of two-up serially advancing blanks produced by one cycle of the die cutter rolls 10 and 12 is provided by the three pairs of top conveyor assemblies 18A–18C illustrated in FIGS. 1,2, and 5. Referring to FIG. 5, each set of conveyor assemblies 18A (assembly sets 18B and 18C being identical to 18A) includes two endless conveyor assemblies each with an X and Y belt mounted for rotation around a single conveyor support assembly 60. The conveyor assemblies are made right and left hand as indicated by the position of the X and Y belts identified in FIG. 2, station 3, Mode 4. As previously explained, the belts X and Y can be run at the same speed when, for example, one-up blanks are being run or, belt X can be run faster and then slower than belt Y when two-up blanks are being run. It should be noted that in FIG. 2, the blanks 14 are shown on top of the conveyors for clarity whereas actually they are held to the bottom of the conveyors by vacuum until they are released to settle on the stack S.

Each top conveyor assembly 18 includes a side plate 62 extending the length of the conveyors. A pair of idler pulleys 64 and 66 are bearing mounted for rotation about a stud 68 secured to one end of the side plate 62. A pair of driven pulleys 70 and 72 are mounted to the opposite end of side plate 62 as best illustrated in FIG. 5 (to be explained). A vacuum chamber 74 is secured to the side plate 62 between the two sets of pulleys and serves to support the upper and lower runs of the belts X and Y that encircle the pulleys on both ends of the side plate. Vacuum chamber 74 includes two rows of vacuum slots 76 extending along its length beneath the lower runs of the belts X and Y (note that FIG. 5 is a bottom view of the conveyor assembly 18A). Belts X and Y include two arrays of vacuum ports 22 in alignment with the vacuum slots 76. Thus, vacuum applied to the interior of chamber 74 is applied to the blanks 14 through ports 22 as they move along over the slots 76 to hold the leading edge portion of the blank against the belts.

In FIG. 5, array of ports 22 in each of belts X and Y are shown in circumferential alignment as they would be when advancing one-up blanks with both belts running at the same constant speed. The blanks advance in the direction of arrow 80 in FIG. 6. The stops 20A and 20B (FIG. 1 and 2) are positioned slightly downstream from the end of conveyor 18A. Thus, just as the last vacuum port 22 passes out of contact with vacuum slot 76 thereby releasing the blank 14 from belts X and Y, the blank hits the frontstops 20A and 20B and settles upon the stack S (FIG. 1).

When two-up blanks are being advanced, the Y belt is retarded such that its initial position with respect to the X belt lags by an amount slightly in excess of the width of the blank 14 in the machine direction at the beginning of a cycle. Thus, the array of vacuum ports 22 in the X belt engages the first blank produced in the cycle. The X belt is accelerated thereby creating a space, which is independent of blank width (in the machine direction), between the first blank and the second blank produced in the cycle. When the first blank is released and hits the stops 20A/20B, it has slowed to approximately the speed of the Y belt and belt X is slowed to a speed slower than the Y belt. Meanwhile, the array of vacuum ports 22 in the Y belt have engaged the second blank of the cycle and advances it at constant speed until it is released and hits the same stops 20A and 20B. The X belt resumes its speed so that the two arrays of vacuum ports 22 in the X and Y belts reach their same relative positions at the time the first blank of the next cycle reaches belt X for engagement thereto by the vacuum ports 22. The foregoing cycle is then repeated thereby providing stacking of two-up blanks on stack S.

Figure 7:
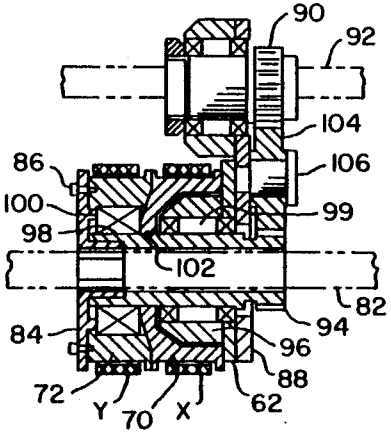
FIG. 7 is a section view of the drive arrangement for the conveyor pair taken along line VIII—VIII of FIG. 6.

The belts X and Y are driven at the same or different speeds by the arrangement shown in FIG. 7. A hexagonal drive shaft 82 passes through a corresponding hexagonal hole in a drive plate 84. Drive plate 84 is secured by screws 86 to the side of pulley 72 so that upon rotation of drive shaft 82, pulley 72 turns belt X at constant speed for one-up operation and varying speed for two-up operation.

Figure 6:
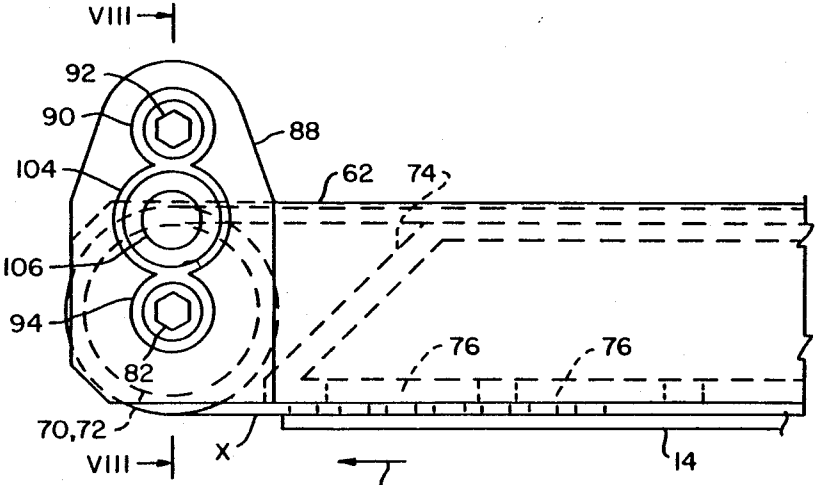
FIG. 6 is a side elevation of the driven end of the conveyor pair of FIG. 5.

A support plate 88 is secured to the end of side plate 62 as shown in FIGS. 6 and 7. A conventional spur tooth drive gear 90 is bearing mounted to support plate 88. Another hexagonal drive shaft 92 passes through a corresponding hexagonal hole in gear 90.

Another drive gear 94 (FIG. 7) loosely surrounds, but does engage, drive shaft 82 and is bearing mounted by bearings 99 within a bearing support 98 secured to the side plate 62. This permits gear 94 to be supported and rotate independently of drive shaft 82. A journal portion 98 provides support for bearing 100 upon which pulley 72 is mounted. Pulley 70 is keyed to the journal portion 98 by key 102. Thus, upon rotation of gear 94, pulley 70 will rotate independently of pulley 72.

An idler gear 104 is mounted on a support stud 106, secured to support plate 88, and in driving engagement with both drive gears 90 and 94. Thus, upon rotation of drive shaft 92, pulley 70 will be driven independently of pulley 72 to turn belt Y a constant speed.

From the foregoing it is evident that a means is needed for controlling the speed of the X belt relative to the constant speed of the Y belt. The speed of the X belt can be controlled by a speed changing mechanism such as a crank shaping mechanism. Such mechanism can be adapted for such purpose; an illustrative embodiment is generally denoted by numeral 110 in FIGS. 8 and 9 although other arrangements will be equally effective.

The speed changing mechanism 110 does two things; one, it provides a constant speed to the X belts when one-up blanks are being processed, such constant speed being equal to the speed of the Y belts as previously explained. And, two, it adds to and subtracts from the speed of the X belts when two-up blanks are being processed. It should be understood that the mechanism 110 is connected to the hexagonal drive shaft 82 (discussed in reference to FIG. 7) by suitable couplings and the like (not shown). It is also connected to be driven in time with the other elements of the stacking apparatus by suitable connection (not shown) as is well understood by those skilled in the art. The Y belts are also driven in similar fashion by the stacking apparatus, such belts being connected for rotation by the hexagonal shaft 92 discussed in reference to FIG. 7. It is not believed necessary to show the actual connections. Timing settings are made by releasing these connections and making the appropriate adjustments of the X set or Y set belts.

Figure 8:
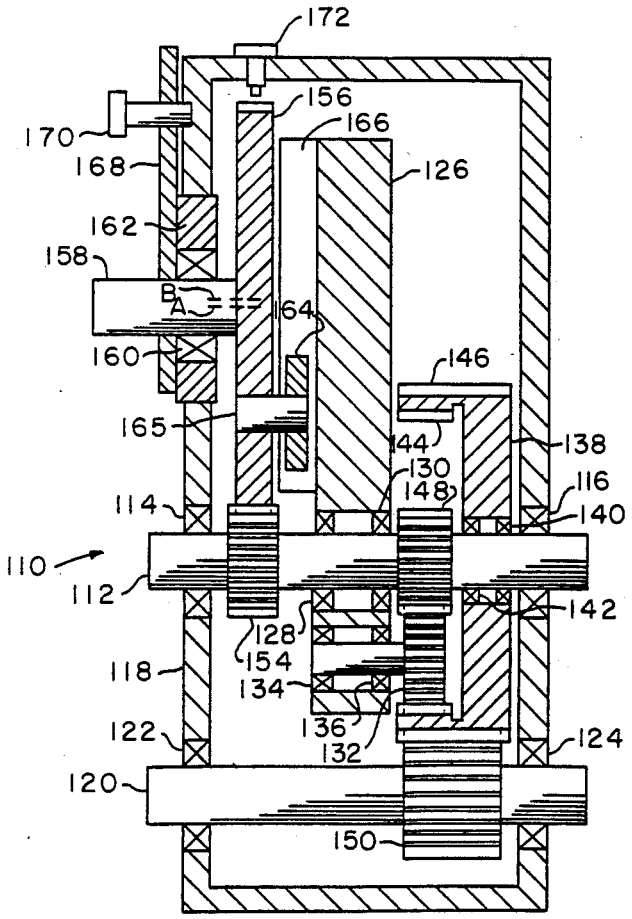
FIG. 8 is a section view of a speed changing mechanism for controlling the speed of the conveyors of FIG. 5.
Figure 9:
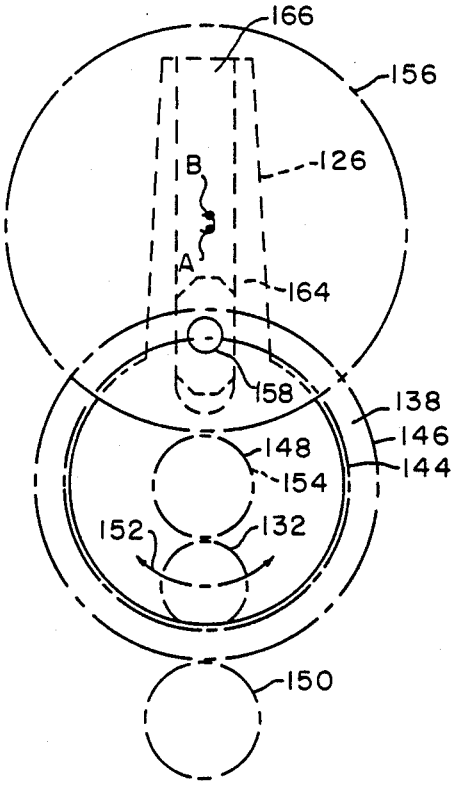
FIG. 9 is a schematic front view of the mechanism of FIG. 8 during an on cycle.

Constant speed to the X belts is provided in the following manner. Referring to FIG. 8, the speed changing mechanism 110 includes an input shaft 112 mounted in bearings 114 and 116 in a gear case 118. An output shaft 120 is also mounted in case 118 by bearings 122 and 124. A crank arm 126 is bearing mounted on bearings 128 and 130 on the input shaft 112 to permit the arm to pivot about the shaft. A planet gear 132, having conventional spur teeth thereon, is supported for rotation in the bottom portion of arm 126 by bearings 134 and 136. A ring gear 138 is mounted for rotation about input shaft 112 by bearings 140 and 142. Ring gear 138 includes both internal teeth 144 and external teeth 146 as shown. A drive gear 148 is formed integral with input shaft 112 so as to be in driving engagement with the planet gear 132 which in turn is in driving engagement with internal teeth 144 on ring gear 138. The external teeth 146 in ring gear 138 are in driving engagement with a driven gear 150 formed integral with output shaft 120. Thus, so long as the crank arm 126 is held stationary (as will be explained), input drive gear 148 drives the output driven gear 150 through the planet gear 132 and the ring gear 138 at a constant speed proportional to the speed at which the input shaft 112 is rotated.

The crank arm 126 is pivoted about input shaft 112 to add to and subtract from the speed of the output shaft 120. Such pivoting is represented by arrow 152 in FIG. 9. As the arm 126 pivots, it carries the planet gear 132 with it, first clockwise and then counter clockwise. In accordance with the well known principles of planetary gearing, as the planet gear 132 moves with the arm 126 in one direction, it will add to the output speed of the already rotating ring gear 138 which, of course, adds to the speed of the output driven gear 150 connected to the hexagonal shaft 82 for the X belt. Conversely, as the arm 126 is pivoted in the opposite direction, the planet gear 132 subtracts from the otherwise constant speed of the output shaft 120 in the same manner.

Pivoting of the crank arm 126 is accomplished by a second drive gear 154 formed integral with the input shaft 112 and in driving engagement with a crank gear 156. Crank gear 156 is formed integral with a support shaft 158 supported for rotation in a bearing 160 held in an eccentric housing 162 arranged for manual rotation in the case 118. A crank slide 164 is mounted to a stud 165 secured to the crank gear 156. The crank slide 164 rides in a slot 166 in crank arm 126. Thus, as crank gear 156 is rotated at constant speed by the second drive gear 154, the stud 166 moves in a circle and the crank slide 164 slides in slot 166 to pivot the crank arm 126 in the known manner. Pivoting of the crank arm 126 results in the addition and subtraction of speed to and from the output shaft 120 as previously explained.

When it is desired to run the X belts at constant speed for processing one-up blanks, it is only necessary to hold the crank arm 126 stationary. This is accomplished by rotating the eccentric housing 162 by preferably 180° from point A to point B (see FIG. 9). This brings the crank gear 156 out of driving engagement with the second drive gear 154 so that crank gear 156 will not rotate. Eccentric housing 126 includes an adjustment arm 168 secured thereto for manually moving the housing 162 from point A to point B.

A suitable detent 170 is mounted to arm 168 to lock the arm in position. Since crank gear 156 is held stationary, the slide 164 locks the crank arm 126 in a stationary position to prevent its tendency to rotate from the torque created by rotation of the planet gear 132 being driven by drive gear 148.

A spring loaded plunger 172 is secured in the case 118 opposite to the crank gear 156. As gear 156 is moved to point B out of engagement with drive gear 154, the plunger 172 seats itself between adjoining teeth on the gear 156 to positively prevent rotation thereof.

Figure 10:
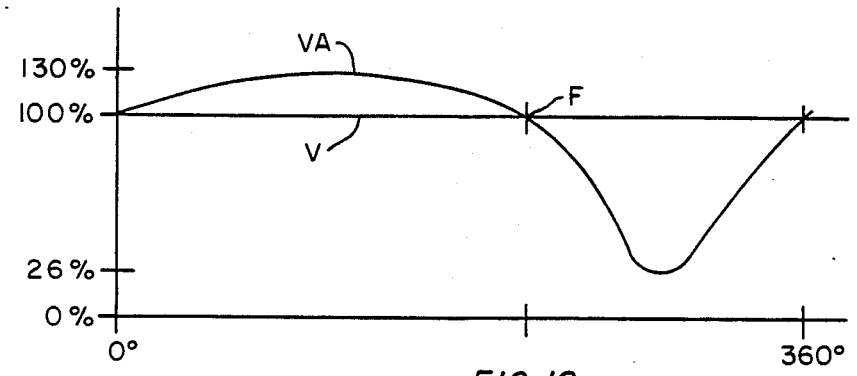
FIG. 10 is a graph showing the output speed of the mechanism of FIG. 8.

The graph of FIG. 10 illustrates the preferred velocity of the output shaft 120 of the speed changing mechanism 110. The first blank 14 is engaged by the first array of holes 22 in belt X at 100% of machine speed as indicated by line V. The belt X accelerates to about 130%, indicated by line VA, of machine speed thereby creating a space between the first and succeeding second blank. The velocity then slows to 100% machine speed at which point, point F, the blank is released by the belt X (the vacuum ports 22 pass out of communication with the vacuum slots 76—FIG. 6) and continues to advance against the stops 20A/20B slightly downstream from belt X at which point the blank settles on the stack S.

Meanwhile, belt X continues to decelerate to about 26% of machine speed for a short period and then accelerates again to 100% of machine speed ready to engage the first blank of the next cycle (the cycle is represented by 360° rotation of the die cutter cylinders 10 and 12). The time that belt X moves at below 100% of the machine speed allows belt Y to catch up while advancing the second blank of the cycle against the front stops so that both belts X and Y are moving at approximately 100% of machine speed at the time the next first blank is engaged by belt X. This maintains the spacing of the array of holes 22 in both belts X and Y so that timing of the conveyor belts is preserved. This arrangement enables the stacking of two-up blanks.

The alignment of two or three-out stacks is improved by the use of side guides and stack splitters. As the blanks 14 leave the inclined conveyor 16, they are traveling in a direction slightly skewed with respect to the machine center line because the conveyors 16 are skewed, as previously explained, to achieve blank separation in the cross-machine direction.

Figure 12:
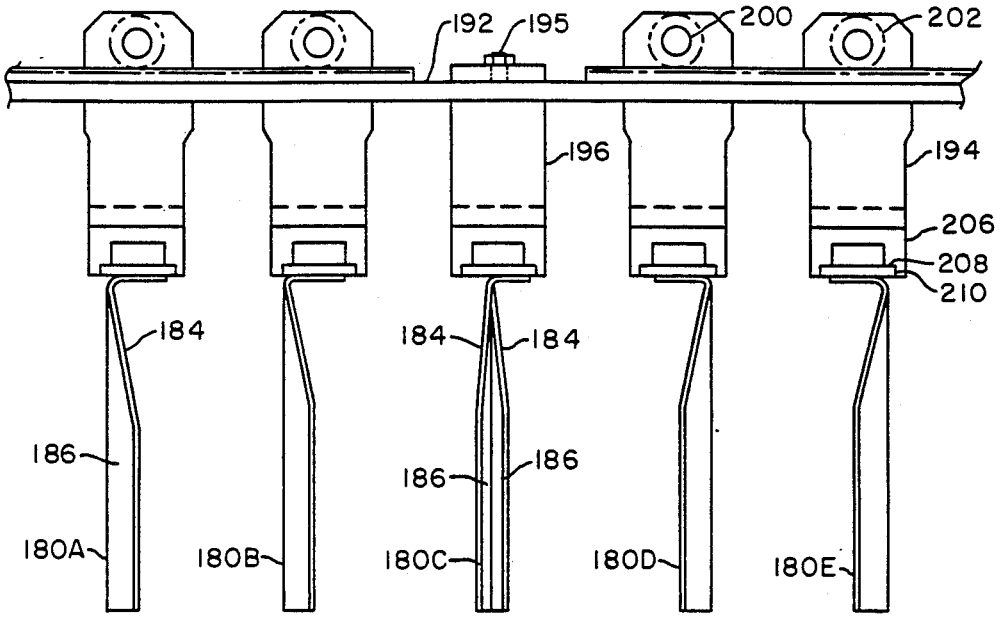
FIG. 12 is an end view of the side guides and splitters of FIG. 9.
Figure 11:
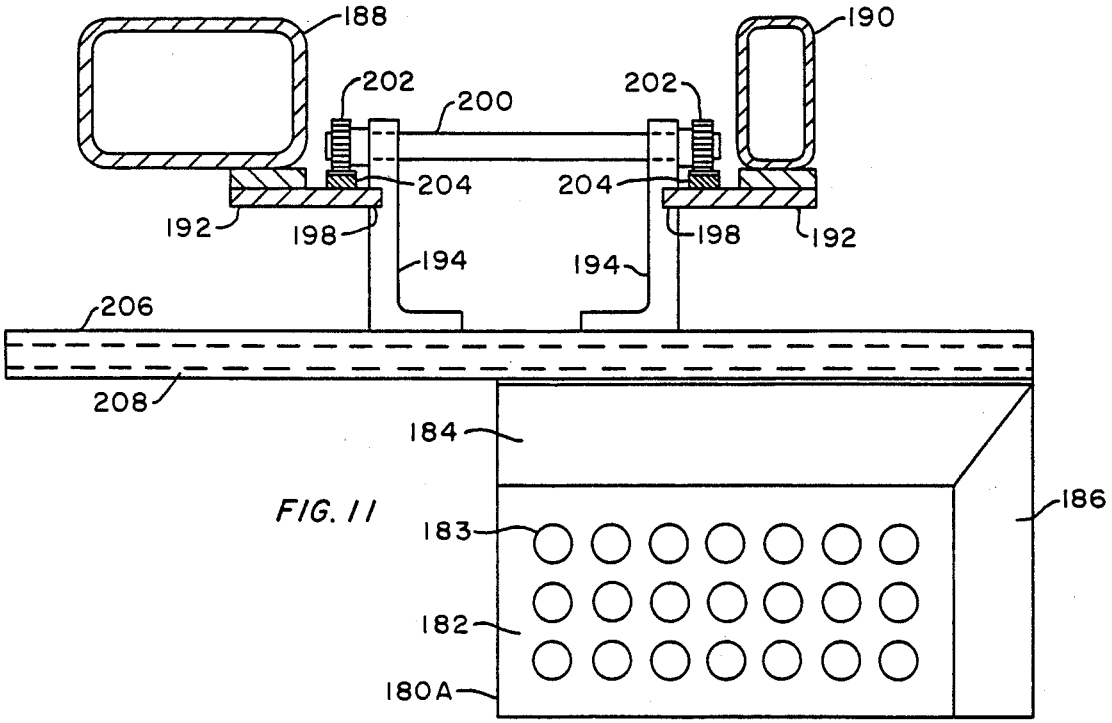
FIG. 11 is a side elevation of the side guides and splitters used to separate the streams of blanks shown in FIG. 2.

The stack splitters are shown in FIGS. 11 and 12 and include a left side splitter 180A, three intermediate splitters 180B, and a right side splitter 180C. The outer splitters 180A and 180C act in place of the side spankers 394 illustrated in the aforementioned patent application Ser. No. 06/472,855 and are located in substantially the same position on the machine at station 3. The splitters 180A and 180C are identical except for being right or left and the intermediate ones being a combination of right and left joined together.

When one-out blanks are being processed, the three intermediate splitters are removed and the blanks are guided between the outer guides or splitters 180A and 180C. When two-out blanks are being processed, one intermediate splitter 180B is placed on the center support 196 and the blanks are guided between the center and right and left splitters. When three-out blanks are being processed, the center splitter 180B is removed and two intermediate splitters are placed on the intermediate supports 194 and the blanks are guided between these and the outboard splitters. The splitters can be positioned in the cross-machine direction (as will be explained) to accommodate the length of the blanks being processed.

Each splitter 180 includes an upstanding leg 182 that has a tapered top portion 184 that permits a blank 14 entering between them to settle in vertical alignment between the upstanding legs 182. The upstanding leg also includes a tapered entrance portion 186 that permits a blank 14 entering at a lower level to be guided between the upstanding legs 182 of the splitters 180 being used. The upstanding legs include a number of holes 183 that permit air to escape between a blank settling upon the stack S and the top of the stack.

The splitters are supported between two cross members 188 and 190 which extend across the width of the machine as station 3. Each cross member includes a guide plate 192 which support outer angle supports 194 and center angle support 196 in guideways 198; this permits the splitters 180 to be positioned in the cross machine direction except for the center splitter 180 whose angle support 196 is clamped to support 192 by a screw 195. Alignment of the angle supports 194 is achieved by shaft 200, extending between the angle supports 194, on each end of which a pinion gear 202 is supported in engagement with a toothed rack 204 that is secured to the guide members 192.

A longitudinal (machine direction) support 206 is secured to the horizontal legs of each pair of the angle supports 194 as shown in FIG. 11. A magnetic bar 208 is secured in a groove 210 in each support 210. The splitters 180 are attached to a ferrous material which will adhere to the magnetic bars 208. This permits the splitters to be positioned in the machine direction along the length of the supports 206 for the most effective position with respect to the width of the blanks 14 being processed. These splitters, along with the front stops 20A and 20B, provide the guiding of the blanks 14 as they descend upon the stack S.

OPERATION

In operation, the die cutting machine represented by cylinders 10 and 12 in FIG. 1 is set up in the well known manner to produce from one to three-out blanks and either one or two-up blanks as shown in FIG. 2.

The pairs of conveyors 16A,B and C of inclined conveyor 16 are skewed as previously described depending on the mode of production selected. They are also positioned in the cross-machine direction to accommodate the length of the blanks 14 being run.

The pairs of conveyors 18A, B and C of the conveyor section 18 are positioned in the cross-machine direction to be substantially in alignment with the conveyors 16A, B and C of the inclined conveyor 16 for receiving blanks 14 therefrom. If one-up blanks are being run, the belts X and Y of the conveyor pairs 18 are adjusted so that the arrays of vacuum ports 22 are in alignment so that the X and Y belts pick up the blanks of each machine cycle at the same time. If, however, two-up blanks are being run, the X and Y belts are adjusted so that the position of the arrays of vacuum ports 22 are offset so that the ports 22 in the X belts engage the first blanks of the machine cycle and the ports 22 in the Y belts engage the second blanks of the machine cycle.

The stops 20A and 20B (FIG. 2), such as backstops 225 illustrated in the aforementioned patent application, are positioned in the machine direction to accommodate the irregular front edges of the blanks being run.

The proper number of splitters 180 (FIG. 12) are selected for the one, two, or three-out mode of blanks being run as previously described and the ones selected are positioned in the cross-machine direction to accommodate the length (in the cross machine direction) of the blanks being run. The splitters are also positioned in the machine direction along supports 206 near the entry end of the timed conveyor assembly 18. The movable stops 20A and 20B (shown in FIG. 1) are positioned such that the distance between them and stop G is slightly greater than the width of the blanks being processed to guide the blanks downward on top of stack S.

The elevator assembly E (FIG. 1), corresponding to assembly 18 in the aforementioned patent application, is raised to its uppermost position to receive blanks 14 released from the timed conveyor assembly 18. The blowers providing vacuum to ducts B corresponding to blowers 76 and 210 of the prior application are turned on to supply vacuum to the inclined conveyor assembly 16 and timed conveyor assembly 18.

The die cutter rolls 10 and 12 are turned on which also causes the inclined conveyors 16 and timed conveyors 18 to rotate. The blanks 14 supplied by the rolls 10 and 12 advance along inclined conveyors 16 and adhere thereto in timed sequence and into contact with timed conveyors 18. The blanks 14 advance beneath the X and Y belts and adhere thereto by virtue of the suction pressure through the holes 22 in the belts until the holes begin to turn around pulleys 70 and 72 thereby blocking off the vacuum and releasing the blank whose forward inertia carries it against the stops 20A and 20B which absorb the shock of impact. The blanks 14 settle upon elevator E which inches downward as a stack of blanks S is formed thereon. The splitters 180 align the side edges of the blanks as they settle upon the elevator E and the stops 20A/20B and G align the lead and trail edges of the blanks.

As the stack of blanks S forms on elevator E, it is caused to inch slowly downward until the desired stack height is reached at which time the tines T (corresponding to tines 308 of the prior application) descend swiftly to just beneath the board line to intercept and store the succeeding oncoming blanks. At the same time, elevator E descends to its lowermost position and the rollers R on elevator E begin rotating to discharge the stack.

After the stack is discharged, elevator E returns to its uppermost position; tines T are withdrawn and the accumulation of blanks 14 thereon settle onto the elevator which beings to inch downward again.

The foregoing arrangement permits the stacking of from one to three-out and either one or two-up blanks in the various combinations shown in FIG. 2. This improves the versatility of the stacking and die cutting apparatus and increases production by being able to stack more than one blank for each revolution of the die cutter cylinders.

Although the previously described method may be performed by other means such as, for example, a pusher that would engage and accelerate the first blank of each pair, the apparatus described above is the preferred apparatus for performing the method. Similarly, upstanding guides on a conveyor could be used to provide cross-machine direction separation of the parallel streams of blanks rather than the use of the skewed conveyor belts described herein.

The method and apparatus described herein provide advantages not found in prior apparatus such as providing blank separation by positively controlling machine components thereby minimizing relative motion at the interface between the belts and the blanks which enables better handling of more complex die cuts and increasing the utilization of the die cut system's production capacity.

Therefore, having described the invention in its preferred embodiment and mode of operation, that which is desired to be claimed by Letters Patent is:

1. Apparatus for stacking a stream of serially advancing blanks comprising:

timed conveyor means for serially advancing and releasing said blanks from beneath said conveyor means, said timed conveyor means having first and second operable positions and, when in said first operable position, having means to advance serially spaced ones of said blanks at a constant velocity and, when in said second operable position, having a first means for advancing a second blank of pairs of blanks in said stream at a constant velocity and a second means for advancing a first blank in said pairs at a velocity initially equal to and then faster than said constant velocity to create a longitudinal space between otherwise adjoining said first and second blanks;

stop means adjacent a discharge end of said timed conveyor means for stopping the advance of said blanks upon their release by said timed conveyor means; and receiving means beneath said timed conveyor means upon which said blanks are stacked following release by said conveyor means.

2. Apparatus for stacking blanks comprising:

timed conveyor means for serially advancing and releasing said blanks from beneath said conveyor means, said timed conveyor means being selectively operable to:

(a) advance serially spaced ones of said blanks; and to (b) create a space between non-serially spaced ones of said blanks while advancing said blanks to permit stacking thereof;

stop means adjacent a discharge end of said timed conveyor means for stopping the advance of said blanks upon their release by said timed conveyor means; and receiving means beneath said timed conveyor means upon which said blanks are stacked following release by said conveyor means;

said timed conveyor means including at least a first pair of laterally adjacent conveyor belt means of which a first conveyor belt of said first pair is rotatable at a substantially constant velocity for advancing a second of a pair of serially advancing blanks at said constant velocity and a second conveyor belt of said first pair is rotatable at a velocity initially equal to and then faster than said constant velocity of said first conveyor belt for advancing a first of said pair of blanks faster than said second blank for creating a space therebetween to advance non-serially spaced ones of said blanks.

3. The apparatus of claim 2 wherein:

said timed conveyor means includes at least one second pair of laterally adjacent conveyor belt means laterally spaced from and operable in substantially the same manner as said first pair for advancing a parallel stream of serially advancing blanks laterally spaced from the blanks being advanced by said first pair of laterally adjacent conveyor belt means.

4. The apparatus of claim 2 wherein:

said timed conveyor means includes a selector means operable to cause said second conveyor belt to rotate at a substantially constant velocity equal to the velocity of said first conveyor belt for advancing serially spaced ones of said blanks.

5. The apparatus of claim 2 wherein:

each of said first and second conveyor belts has a circumference substantially equal to twice the maximum length of said blanks that can be stacked by said apparatus and includes at least two arrays of vacuum ports therein spaced substantially equidistant around said circumference for engaging leading edge portions of said blanks to cause said blanks to adhere to said conveyor belts during rotation thereof.

6. The apparatus of claim 5 wherein:

one of said first and second conveyor belts is adapted to be circumferentially offset with respect to the other of said belts so that the arrays of said vacuum ports in one of said belts engages the leading edge portion of a first of said non-serially spaced ones of said blanks and the arrays of said vacuum ports in the other of said belts engages the leading edge portion of a second following blank of said non-serially spaced ones of said blanks.

7. The apparatus of claim 3 wherein:

said stacking apparatus further includes a second conveyor means ahead of said timed conveyor means adapted to create a space between parallel streams of advancing blanks in a cross-machine direction to provide a first stream of blanks to said first pair of laterally adjacent conveyor belt means and a second stream of blanks, laterally spaced from said first stream, to said second pair of laterally adjacent conveyor belt means.

8. The apparatus of claim 7 wherein:

said second conveyor means includes at least two endless conveyor belts of which at least one can be skewed relative to the other so that a stream of said blanks on one of said endless conveyor belts advances at an angle with respect to a stream of said blanks on the other of said endless conveyor belts to create a space between said streams in a cross-machine direction.

9. The apparatus of claim 3 wherein:

said timed conveyor means includes splitter means for maintaining separation between a first stream of said blanks being advanced by said first pair of laterally adjacent conveyor belt means and a second stream of blanks being advanced by said second pair of laterally adjacent conveyor belt means.

10. A method of stacking a stream of serially advancing blanks comprising the steps of:

(a) serially advancing a first stream of pairs of blanks in which there are longitudinal spaces between said pairs and no longitudinal spaces between the blanks in said pairs;

(b) advancing the second blank of said pairs of blanks at a constant velocity and advancing the first blank in said pairs at a velocity initially equal to and then faster than said constant velocity thereby creating longitudinal spaces between said first and second blanks;

(c) stopping the advance of said blanks one after the other following the creation of said longitudinal spaces; and (d) guiding said blanks one on top of the other to form a first stack thereof.

11. The method of claim 10 further including the steps of:

(a) serially advancing a second stream of pairs of blanks, laterally adjacent to said first stream of blanks, in which there are longitudinal spaces between said pairs and no longitudinal spaces between the blanks in said pairs;

(b) creating a lateral space between said first and second streams of blanks during the advance thereof;

(c) advancing the second blank of said pairs in said second stream at a constant velocity while advancing a first blank in said pairs at a velocity initially equal to and then faster than said constant velocity thereby creating longitudinal spaces between said first and second blanks in said second stream;

(d) stopping the advance of said blanks in said second stream one after the other; and (e) guiding said blanks in said second stream one on top of the other to form a second stack of said blanks laterally spaced from said first stack.

* * * * *